US010470617B1

(12) United States Patent
Hopson et al.

(10) Patent No.: US 10,470,617 B1
(45) Date of Patent: Nov. 12, 2019

(54) BATHING APPARATUS

(71) Applicants: Valeria Hopson, Hazelwood, MO (US); Stephanie Cunningham, St Louis, MO (US)

(72) Inventors: Valeria Hopson, Hazelwood, MO (US); Stephanie Cunningham, St Louis, MO (US)

( * ) Notice: Subject to any disclaimer, the term of this patent is extended or adjusted under 35 U.S.C. 154(b) by 318 days.

(21) Appl. No.: 15/396,758

(22) Filed: Jan. 2, 2017

(51) Int. Cl.

| | |
|---|---|
| ***A47K 7/02*** | (2006.01) |
| ***A47K 10/02*** | (2006.01) |
| ***A47L 13/16*** | (2006.01) |
| ***B08B 1/00*** | (2006.01) |

(52) U.S. Cl.
CPC ..... *A47K 7/02* (2013.01); *A47K 10/02* (2013.01); *A47L 13/16* (2013.01); *B08B 1/006* (2013.01)

(58) Field of Classification Search
CPC . A47K 7/00; A47K 7/02; A47K 7/022; A47K 7/03; A47K 10/00; A47K 10/02; A47L 13/00; A47L 13/10; A47L 13/16; A47L 13/17; A47L 13/26; A47L 25/00; B08B 1/00; B08B 1/001; B08B 1/006; B08B 13/00; A63B 57/00; A63B 57/60; A63B 2057/605; A63B 60/36
USPC ..... 15/105, 208, 209.1, 210.1, 244.1, 244.4, 15/246; 401/52, 195
See application file for complete search history.

(56) References Cited

U.S. PATENT DOCUMENTS

| | | | | |
|---|---|---|---|---|
| 4,516,616 | A * | 5/1985 | Fesler | A63B 57/00 150/154 |
| 2012/0256067 | A1* | 10/2012 | Dastrup | A63B 55/408 248/225.21 |
| 2015/0004352 | A1* | 1/2015 | Sohn | A47K 10/02 428/99 |
| 2017/0340184 | A1* | 11/2017 | Muhammad | A47L 25/00 |

FOREIGN PATENT DOCUMENTS

WO 2015/004623 * 1/2015

* cited by examiner

*Primary Examiner* — Mark Spisich
(74) *Attorney, Agent, or Firm* — Gulf Coast Intellectual Property Group

(57) ABSTRACT

A bathing apparatus configured to broadcast an audio signal while in use during the execution of a personal hygiene protocol. The bathing apparatus includes a cleaning cloth configured to have surfactant disposed thereon. The cleaning cloth is operably coupled to an entertainment module. The entertainment module has a central housing that has disposed therein an audio speaker wherein the audio speaker is further operably coupled to a wireless receiver. A mounting ring is circumferentially mounted to the central housing and is releasably secured thereto. The mounting ring includes a plurality of surfactant segments wherein the surfactant segments are configured to be abraded onto the cleaning cloth so as to deposit a portion thereof. The entertainment module is operably coupled to the cleaning cloth utilizing an attachment chain. A power supply is disposed within the central housing of the entertainment module.

18 Claims, 1 Drawing Sheet

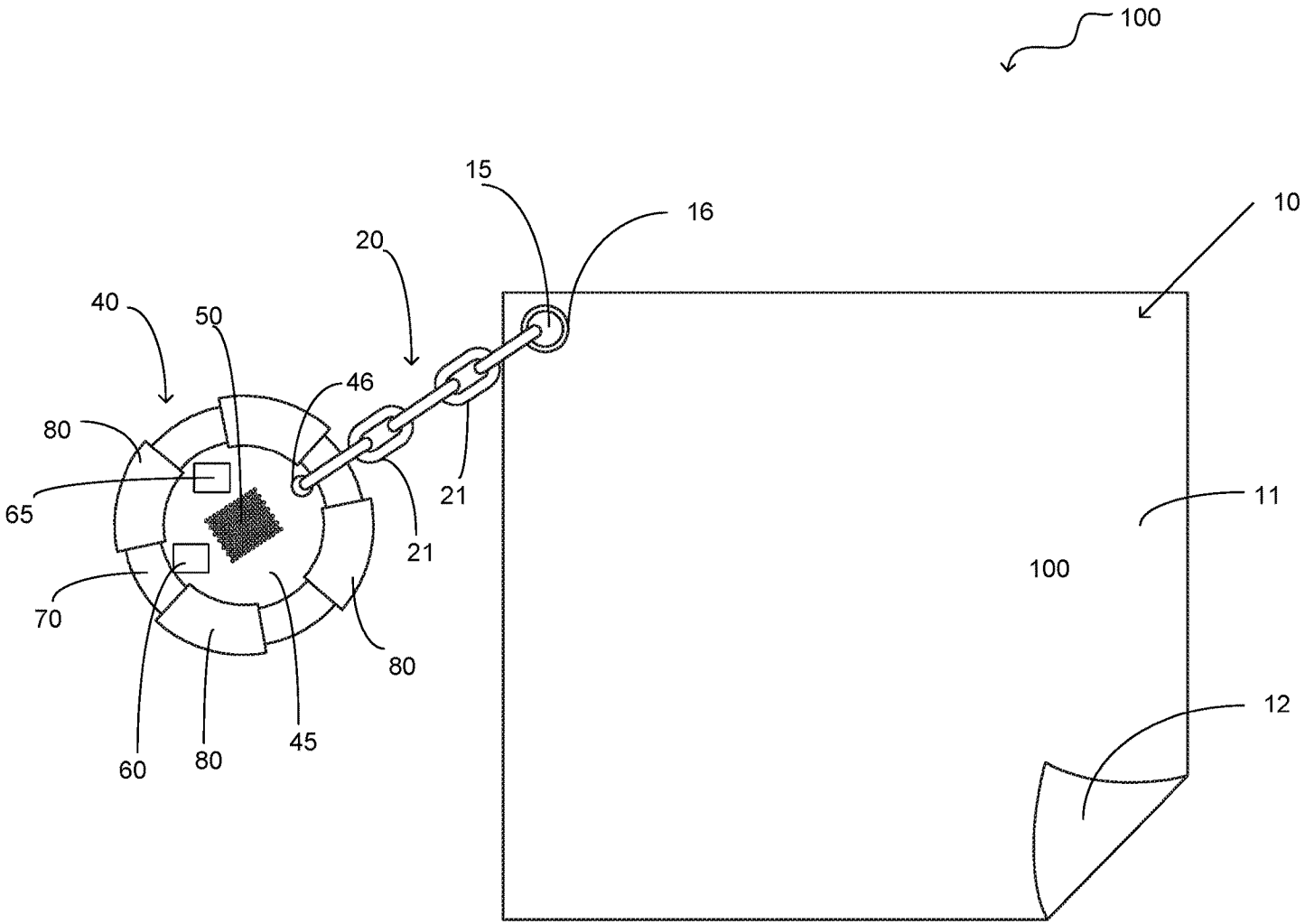
100
10
11
12
100
16
15
21
21
20
46
80
45
50
80
40
60
80
65
70

BATHING APPARATUS

FIELD OF THE INVENTION

The present invention relates generally to hygiene and products used therefore, more specifically but not by way of limitation, a bath apparatus that is operable to effectively clean the human body and further include an entertainment module operably coupled thereto.

BACKGROUND

Millions of people are engaged in care and raising of infants and children on a daily basis. The demands of raising a child are endless and include everything from providing food and shelter to ensuring an education. One routine task that is executed on a daily basis is bathing. Children require assistance during the bathing process to ensure their bodies are effectively and properly cleaned. As children get older, many can begin to bath themselves but still require some supervision to ensure they are properly cleaning themselves. Whether the child is being bathed by a caretaker or has begun to bath themselves, a cleaning device of some sort will be utilized to provide effective cleaning of the body. Common cleaning articles such as but not limited washcloths and sponges are routinely utilized to provide effective cleaning of the body of a child.

One issue with conventional cleaning articles such as but not limited to washcloths is that they do not promote engagement therewith. As many caretakers and parent will understand, getting a child to participate and/or conduct a proper cleaning can be challenging. Many children as they begin to learn to clean themselves will not utilize articles such as conventional washcloths properly resulting in poor hygiene. Conventional washcloths lack any additional features that promote engagement therewith and as such proper and/or improved hygiene.

Accordingly, there is a need for bathing apparatus that promotes engagement therewith so as to assist a child in developing and practicing good bathing hygiene.

SUMMARY OF THE INVENTION

It is the object of the present invention to provide a bathing apparatus that is operable promote engagement therewith in order to deliver an effective hygiene routine.

Another object of the present invention is to provide a bathing apparatus that is operable to promote an effective hygienic cleaning routine that includes a cleaning cloth.

A further object of the present invention is to provide a bathing apparatus configured to assist a user in a hygiene routine wherein the bathing apparatus further includes an entertainment module.

Still another object of the present invention is to provide a bathing apparatus operable to assist a user in performing a hygiene routine wherein the entertainment module includes a waterproof housing.

An additional object of the present invention is to provide a bathing apparatus configured to promote engagement therewith so as to provide an effective cleaning routine wherein the entertainment module is operable to provide either audio and/or video entertainment.

Yet a further object of the present invention is to provide a bathing apparatus that functions to assist a user in executing a cleaning routine wherein the cleaning cloth further includes an aperture.

Another object of the present invention is to provide a bathing apparatus operable to assist a user in cleaning of their bodies wherein the bathing apparatus further includes an attachment mechanism configured to secure the entertainment module to the cleaning cloth.

Still an additional object of the present invention is to provide a bathing apparatus wherein the entertainment module includes a base and an outer ring and wherein the outer ring is removable and has secured thereto replaceable surfactant segments.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

FIG. 1 is a perspective view of an embodiment of the present invention.

DETAILED DESCRIPTION

Referring now to the drawings submitted herewith, wherein various elements depicted therein are not necessarily drawn to scale and wherein through the views and figures like elements are referenced with identical reference numerals, there is illustrated a bathing apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures.

Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to FIG. 1 herein, the bathing apparatus 100 further includes a cleaning cloth 10. The cleaning cloth 10 includes a first side 11 and a second side 12 and is manufactured from a suitable material such as but not limited to cotton. The cleaning cloth 10 is planar in manner and square in shape but it is contemplated within the scope of the present invention that the cleaning cloth 10 could be formed in alternate shapes. It is further contemplated within the scope of the present invention that the cleaning cloth 10 could be replaced by other conventional cleaning articles such as but not limited to a sponge. The cleaning cloth 10 includes an aperture 15 that is journaled therethrough. The aperture 15 includes rim 16 wherein the rim 16 functions to maintain the structural integrity of the aperture 15. The aperture 15 provides an interface to engage attachment chain 20. The attachment chain 20 is manufactured of links 21 and is configured to couple the cleaning cloth 10 to the entertainment module 40. It is contemplated within the scope of the present invention that the attachment chain 20 could be various lengths. Furthermore, it is desired within the scope of the present invention that the attachment chain 20 is manufactured from plastic so as to be water resistant. Those skilled in the art that alternate materials could be utilized to construct the attachment chain 20.

Secured to the attachment chain 20 distal to the cleaning cloth 10 is the entertainment module 40. The entertainment module 40 includes a central housing 45 that is annular in shape. The central housing 45 is manufactured from a suitable durable material such as but not limited to plastic. The central housing 45 is constructed to be waterproof and further include an interior volume (not illustrated herein). Disposed within the central housing 45 is an audio speaker 50. The audio speaker 50 is operably coupled to power supply 60 and receiver 65. The receiver 65 is configured to receive an audio signal from an alternate device such as but not limited to a music player wherein the music player is configured to broadcast a wireless signal such as but not limited to Bluetooth. The receiver 65 receives the wirelessly transmitted audio signal from a music player proximate thereto and broadcasts the audio signal via the speaker 50. It is further contemplated within the scope of the present invention that the central housing 45 could have disposed therein a central processing unit having memory and the necessary electronics wherein the memory has pre-recorded music data files stored therein for play by the audio speaker 50. While the central housing 45 is illustrated herein as being annular in shape, it is contemplated within the scope of the present invention that the central housing 45 could be manufactured in alternate shapes. The central housing 45 further includes hole 46 journaled therethrough wherein hole 46 is configured to be secured to attachment chain 20.

Releasably secured to the central housing 45 is the mounting ring 70. The mounting ring 70 is releasably secured to the central housing 45 utilizing suitable durable techniques and is shaped so as to circumferentially surround the central housing 45. Releasably secured to the mounting ring 70 are surfactant segments 80. The surfactant segments 80 are manufactured from solid surfactant materials and are configured to be frictionally engaged with the cleaning cloth 10 so as to deposit a portion thereof onto the cleaning cloth 10 for use during a cleaning routine. In use, a user will engage the mounting ring 70 and surfactant segments 80 with the cleaning cloth 10 and execute a reciprocating or other similar motion so as to transfer a portion of the surfactant segments 80 to the cleaning cloth 10. Subsequent to the deposit of a portion of the surfactant segments 80 onto the cleaning cloth 10, a user will use the cleaning cloth 10 to cleanse a desire portion of their body. The surfactant segments 80 are cylindrical in shape having a hollow passage therethrough so as to be slidably secured to the mounting ring 70. It is contemplated within the scope of the present invention that the mounting ring 70 could be constructed in numerous manners so as to allow the surfactant segments 80 to be coupled thereto ensuing the separation of the mounting ring 70 from the central housing 45. Further, it is contemplated within the scope of the present invention that the mounting ring 70 could be releasably secured to the central housing 45 utilizing numerous alternate styles of fasteners. While four surfactant segments 80 are illustrated herein, it is contemplated within the scope of the present invention that the mounting ring 70 could have releasably secured thereto less than four surfactant segments 80. It is further contemplated within the scope of the present invention that the surfactant segments 80 could be manufactured in various colors.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A bathing apparatus comprising:

a cleaning cloth, said cleaning cloth having a first side and a second side;

an entertainment module, said entertainment module having a housing, said housing being waterproof, said entertainment module configured to broadcast an audio signal;

an attachment chain, said attachment chain having a first end and a second end, said first end of said attachment chain being coupled to said cleaning cloth, said second end of said attachment chain being coupled to said entertainment module; and a mounting ring, said mounting ring being releasably secured to said housing of said entertainment module, wherein the mounting ring further includes at least one surfactant segment secured thereto, said at least one surfactant segment configured to be abraded onto said cleaning cloth.

2. The bathing apparatus as recited in claim 1, and further including an audio speaker, said audio speaker disposed within said housing of said entertainment module.

3. The bathing apparatus as recited in claim 2, and further including a receiver, said receiver being disposed within said housing, said receiver operably coupled to said audio speaker, said receiver configured to receive a wireless audio signal.

4. The bathing apparatus as recited in claim 3, wherein said cleaning cloth further includes an aperture, said aperture configured to couple to said first end of said attachment chain.

5. The bathing apparatus as recited in claim 4, wherein said housing further includes a hole, said hole configured to couple to said second end of said attachment chain.

6. A bathing apparatus operable to be utilized by an individual during the execution of a personal hygiene procedure comprising:

a cleaning cloth, said cleaning cloth having a first side and a second side, said cleaning cloth being planar in manner;

an entertainment module, said entertainment module having a central housing, said central housing being annular in shape and having an interior volume, said central housing being waterproof, said entertainment module configured to broadcast an audio signal;

a mounting ring, said mounting ring being circumferentially mounted to said central housing, said mounting ring being releasably secured to said central housing; and an attachment chain, said attachment chain having a first end and a second end, said first end of said attachment chain being coupled to said cleaning cloth, said second end of said attachment chain being coupled to said entertainment module.

7. The bathing apparatus as recited in claim 6, and further including an audio speaker, said audio speaker disposed within said central housing of said entertainment module.

8. The bathing apparatus as recited in claim 7, and further including a receiver, said receiver being disposed within said central housing, said receiver operably coupled to said audio speaker, said receiver configured to receive a wireless audio signal.

9. The bathing apparatus as recited in claim 8, wherein said cleaning cloth further includes an aperture, said aperture configured to couple to said first end of said attachment chain, said aperture further including a rim, said rim circumferentially surrounding said aperture.

10. The bathing apparatus as recited in claim 9, wherein the mounting ring further includes a plurality of surfactant segments secured thereto, said plurality of surfactant segments being cylindrical in shape and having a hollow passage therethrough.

11. The bathing apparatus as recited in claim 10, wherein said central housing further includes a hole, said hole configured to couple to said second end of said attachment chain.

12. The bathing apparatus as recited in claim 11, wherein said cleaning cloth is manufactured from cotton.

13. A bathing apparatus configured to provide audio entertainment during execution of a personal hygiene protocol comprising:

a cleaning cloth, said cleaning cloth having a first side and a second side, said cleaning cloth being planar in manner;

an entertainment module, said entertainment module having a central housing, said central housing being annular in shape and having an interior volume, said central housing being waterproof, said entertainment module configured to broadcast an audio signal;

a mounting ring, said mounting ring being circumferentially mounted to said central housing, said mounting ring being releasably secured to said central housing;

a plurality of surfactant segments, said plurality of surfactant segments secured to said mounting ring, said plurality of surfactant segments being cylindrical in shape and having a hollow passage therethrough; and an attachment chain, said attachment chain having a first end and a second end, said first end of said attachment chain being coupled to said cleaning cloth, said second end of said attachment chain being coupled to said entertainment module.

14. The bathing apparatus as recited in claim 13, and further including an audio speaker, said audio speaker disposed within said central housing of said entertainment module.

15. The bathing apparatus as recited in claim 14, and further including a receiver, said receiver being disposed within said central housing, said receiver operably coupled to said audio speaker, said receiver configured to receive a wireless audio signal.

16. The bathing apparatus as recited in claim 15, wherein said cleaning cloth further includes an aperture, said aperture configured to couple to said first end of said attachment chain, said aperture further including a rim, said rim circumferentially surrounding said aperture.

17. The bathing apparatus as recited in claim 16, wherein said cleaning cloth is manufactured from cotton.

18. The bathing apparatus as recited in claim 17, wherein said central housing further includes a hole, said hole configured to couple to said second end of said attachment chain.

* * * * *